US008371546B2

(12) United States Patent
Bauerly

(10) Patent No.: US 8,371,546 B2
(45) Date of Patent: Feb. 12, 2013

(54) PURSE HANGER

(76) Inventor: Shelly Lenna Bauerly, Beverly Hills, CA (US)

( * ) Notice: Subject to any disclaimer, the term of this patent is extended or adjusted under 35 U.S.C. 154(b) by 1544 days.

(21) Appl. No.: 10/763,426

(22) Filed: Jan. 23, 2004

(65) Prior Publication Data

US 2005/0161570 A1 Jul. 28, 2005

(51) Int. Cl.
*A47G 29/00* (2006.01)
*F16B 45/00* (2006.01)

(52) U.S. Cl. ..... 248/304; 248/215; 248/339; 248/914; 24/265 H

(58) Field of Classification Search ..... 248/303, 248/304, 317, 214, 215, 914, 308, 309.1, 248/339, 340, 322, 915; 24/265 H, 265 WS; 223/120

See application file for complete search history.

(56) References Cited

U.S. PATENT DOCUMENTS

| | | | | |
|---|---|---|---|---|
| 2,064,133 | A | 12/1936 | Von Schmeder | |
| 3,321,166 | A | 5/1967 | Gordon | |
| D229,870 | S | 1/1974 | Czarny | |
| 4,194,714 | A | 3/1980 | Schultz | |
| D256,738 | S | 9/1980 | Dockery | |
| D300,882 | S | 5/1989 | Olson | |
| 5,094,417 | A * | 3/1992 | Creed | 248/215 |
| 5,594,419 | A | 1/1997 | Lo | |
| D384,505 | S | 10/1997 | Stewart | |
| D409,399 | S | 5/1999 | Robinson | |
| D429,899 | S | 8/2000 | Schwartz | |
| D435,733 | S | 1/2001 | Osterholt | |
| 6,345,796 | B1 | 2/2002 | Neuman | |
| D456,280 | S | 4/2002 | Osterholt | |
| D462,172 | S | 9/2002 | Aurelio, Jr. | |
| 6,557,329 | B2 * | 5/2003 | Schmidt | 54/85 |
| 6,694,574 | B1 * | 2/2004 | Sheng | 24/265 H |
| 2003/0150889 | A1 * | 8/2003 | Caroselli et al. | 223/120 |
| 2004/0195484 | A1 * | 10/2004 | Sheeran | 248/304 |
| 2005/0161570 | A1 * | 7/2005 | Bauerly | 248/317 |

FOREIGN PATENT DOCUMENTS

| | | | |
|---|---|---|---|
| GB | 2253998 | * | 9/1992 |
| JP | 10-113275 | * | 5/1998 |

* cited by examiner

*Primary Examiner* — Tan Le
(74) *Attorney, Agent, or Firm* — Ronald R. Shea, Esq.

(57) ABSTRACT

A purse hanger for hanging a purse from a flat surface has a rigid interface member defining a substantially planar interface area that is co-planar with the flat surface during use. A rigid arm has a proximal end swivelably coupled with the rigid interface member and a distal end, which, in use, is oriented by gravity to a position vertically beneath the planar interface area. A flexible member has a first end coupled to the distal end of the rigid arm, and a second end coupled to a purse engagement member such as a rigid loop securing the purse strap. The flexible member allows the rigid interface member to be stored in the purse while the purse engagement member remains secured to the purse strap. The rigid interface member can have a storage cavity for storing personal items.

37 Claims, 5 Drawing Sheets

70
71
76
78
75
77
62
63
60
61
55
45
49
51
50
46
38
44
27
29
34
32
12
3
6
9
22
31
29
58
59
38a
38b 56
57
8

64
65

62
65
60
64
16A
16A
61
55

47
37
38
22

45
51
49
22
35
29
34
83
82
43
30
41

62
60
66
65
61

PURSE HANGER

BACKGROUND OF THE INVENTION

1. Field of the Invention

The present invention is directed to the field of mechanical devices. More particularly, the present invention is directed to a purse hanger for hanging purses and handbags from tabletops and surfaces.

2. Description of the Prior Art

At coffeehouses, restaurants, bars, or indoor and outdoor cafes, people crowd at tables with limited space. In addition to space for food and drink, table tops are often called upon to support ash trays, chess boards, books, newspapers, etc. Those who carry purses and handbags often crowd their handbags into the center of the table. Purses and handbags on a tabletop reduce the space on the tabletop, and are an annoyance when reaching for food, drink, or other items. Some handbag users choose to sit with their handbags on their respective laps, creating a less than leisurely atmosphere. Others elect to place their handbag on the floor or sidewalk next to their chair, under their chair, or beneath the table. Multiple inconveniences abound from these options, however. Floors and sidewalks are often unsanitary, and wholly unsuitable for contact with anything other than the bottom of one's shoe. Additionally, purses and handbags which are placed next to or under a chair are completely out of the line of sight of the owner, and can be stolen without the knowledge of the owner until it is time to leave. Even when not stolen, the vigilance required to continually check on a purse or handbag beneath a chair again detracts from the leisure and pleasure of a café or restaurant experience.

Purse hangers for hanging a purse from a table often align the weight of a purse in an unstable position, causing the purse holder to slide off the table. Bolting or fastening a purse hanger to a table top prevents a purse hanger from sliding off the table, but are only useful when a purse owner sits at the table fitted with the fixed-in-place purse hanger. Prior art purse hangers that are carried in a purse are easily lost within the purse, and difficult to find among other various items stored within a purse.

There remains therefore a need for a purse holder that can easily be located without becoming lost in the purse of a user. There is also a need for a purse holder that will not readily slide off a tabletop.

BRIEF SUMMARY OF THE INVENTION

According to an embodiment of the invention, a purse hanger for hanging a purse from a flat surface comprises a rigid interface member defining a substantially planar interface area that is co-planar with the flat surface. A rigid arm has a proximal end coupled with the rigid interface member and a distal end oriented vertically beneath the planar interface area. The proximal end can be swivelably coupled to the rigid interface member, or fixedly coupled, according to alternative embodiments. A flexible member has a first end coupled to the distal end of the rigid arm, and a second end coupled to a purse engagement member for engaging a strap of a purse.

According to one embodiment, the rigid arm is detachably coupled with the rigid interface member.

The rigid interface member can have a storage cavity, which can contain various personal items including, but not limited to one or more shades of lip gloss, foundation, make up, vitamins, drugs, a timepiece, a cellular telephone, a camera and combinations thereof. The storage cavity can be divided into multiple storage spaces by modular inserts.

A cover for covering the storage cavity has a securement means for securing the cover to the rigid interface member. The securement means may include, but is not limited to snaps, clasps, hooks, hinges, magnets, threaded members, and combinations thereof.

The rigid arm can include a horizontal extension parallel with the planar interface area, and a vertical extension that is about perpendicular to the horizontal extension. The vertical extension can include a lengthening means for altering a length of the vertical extension. The flexible member will preferably have at least one swivel joint, which can include a top swivel member coupled to the distal end of the rigid arm, a bottom swivel member coupled to the purse engagement member, or a swivel link.

The purse engagement member is advantageously formed from a rigid loop having a movable loop member movably engaged to a primary loop member. When the movable loop member is in a first position, the purse engagement loop is a closed loop, and when the movable loop member is in a second position, the purse engagement member is an open loop. The movable loop member can be movably engaged to the primary loop member through a pivot means or through a slide means, such as a tubular member into which the movable loop member can retract. A spring member urges the movable loop member toward the first position.

A method for storing a purse hanger comprises the steps of securing the purse engagement member to a purse handle, opening the purse, flexing the flexible member, and, placing the rigid interface member within the purse, wherein the purse engagement member remains secured to the purse strap.

DETAILED DESCRIPTION OF THE INVENTION

Overview

Figure 1:
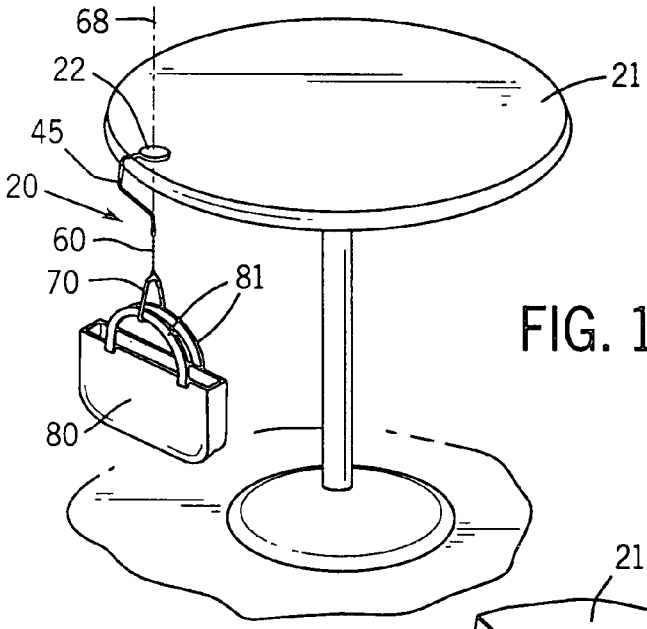
FIG. 1 is an isometric view of a purse supported from a table by the purse holder of the present invention.
Figure 2:
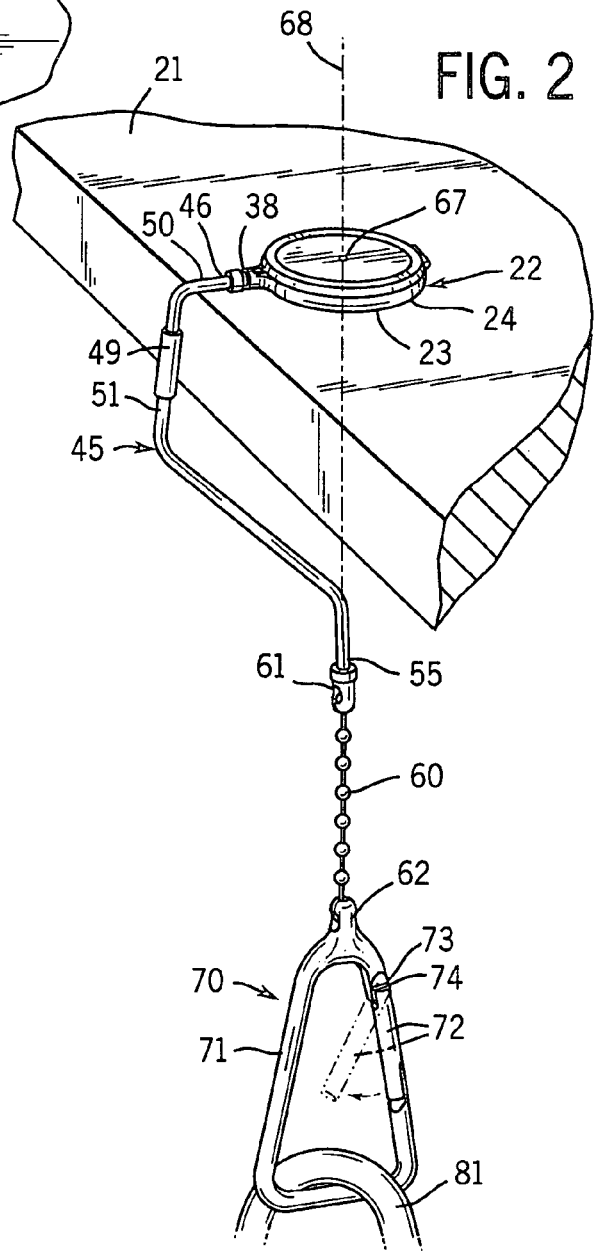
FIG. 2 is an enlarged isometric view of an embodiment of the purse holder of FIG. 1 with a hinged movable loop member.

Referring primarily to FIGS. 1 and 2, a purse hanger 20 for hanging a purse 80 from a horizontal surface such as a tabletop 21 has a rigid interface member 22. As used herein, the term purse includes any handbag device having at least one handle 81 for carrying by hand, or for looping over a shoulder, and a compartment area for carrying personal items and chattels.

A rigid arm 45 extends horizontally outward from the rigid interface member. The rigid arm 45 has a proximal end 46 and a distal end 55. The proximal end is coupled to the neck 38 of the rigid interface member 22. Preferably, the neck is pivotably coupled to the rigid arm, thereby allowing the distal end to pivot to a lowest gravitational position. Embodiments are envisioned, however, wherein the rigid arm 45 is secured to the neck 38 in a non-pivoting relationship.

Figure 13:
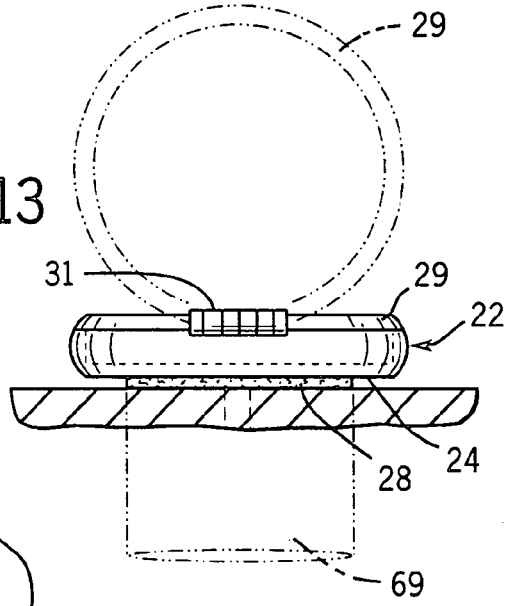
FIG. 13 is a front elevational view of an embodiment of the purse holder of FIG. 1 showing a hinged cover coupled to the top end of the rigid interface member and padding coupled to a bottom surface of the rigid interface member.
Figure 18:
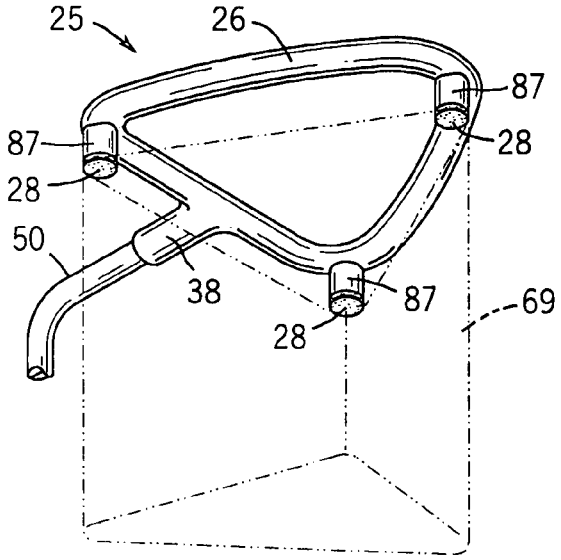
FIG. 18 is an alternative embodiment of a purse hanger having a rigid interface member comprising a frame with multiple legs.

The rigid interface member 22 has a planar interface area 23. In the embodiment of FIG. 2, the planar interface area is about co-extensive with the bottom surface of the rigid interface member. In the embodiment of FIG. 13, the planar interface area 23 is defined by the bottom surface of a pad 28 in contact with the tabletop 21. In the embodiment of FIG. 18, the planar interface area 23 is a substantially triangular area with the corners of the triangle established by the position of the three legs 87. As discussed in greater detail herein, a purse will hang in a stable orientation from a purse hanger 20 if the distal end 55 of the rigid arm 45 is positioned vertically beneath the planar interface area 23.

A flexible member 60 is secured to the distal end 55 through an upper flexible member coupling 61, and to a purse engagement member shown as a rigid loop 70 through a lower flexible member coupling 62. One or more straps 81 of a purse 80 are placed within the rigid loop. The rigid interface member 22 is placed on a table top, and the purse hangs from the table top, suspended by the purse holder. Certain prior art purse holders have suspended a purse strap from the tip of a metal rod, potentially damaging or even poking a hole in an expensive purse strap. Because the strap rests in a rigid loop, the present invention does not inflict damage to purse straps.

Figure 3:
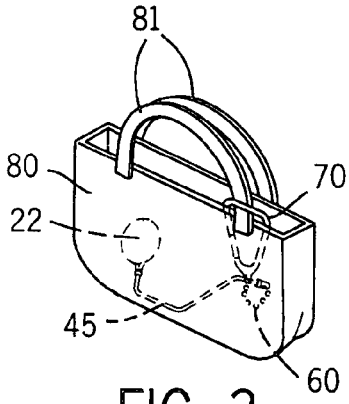
FIG. 3 is an isometric view of the purse holder of FIG. 1 partially stored within a purse while the purse engagement loop remains engaged to a purse handle.
Figure 4:
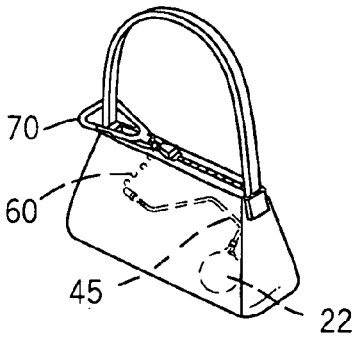
FIG. 4 is an isometric view of the purse holder of FIG. 1 partially stored within a purse while the purse engagement loop remains engaged to a purse handle.

A common inconvenience of prior art purse holders has been that, when stored within the purse, subsequent use requires searching for the purse holder amidst a purse full of personal items, or abandoning the search and storing the handbag or purse below the table or in a traditional manner. An advantage of the present invention is the flexible member 60. Referring primarily to FIGS. 3 and 4, when the purse hanger is not in use, the flexible member 60 of the present invention allows most of the purse hanger 20 to be stored inside the purse 80 while the purse engagement member 70 remains secured to a purse strap 81. Because the purse hanger can be easily located in the purse due to its connection to the purse strap 81, the purse holder is easily located no matter how many personal items are stored in a purse.

The Interface Member

Referring primarily to FIGS. 5 and 9-16, the rigid interface member 22 has a flat bottom surface 24 defining the planar interface 23 for resting parallel to a tabletop 21. The planar interface area 23 can be coextensive with the bottom surface 24 of the rigid interface member, as shown in FIG. 2, or can be defined by padding 28 attached to the bottom surface, as shown in FIG. 13 and discussed further below.

An alternative embodiment shown in FIG. 18 includes a multi-leg embodiment 25 of a rigid interface member comprising a frame 26 with three legs 87 extending therefrom. The distal ends of the legs individually interface with a tabletop 21, and thereby define a geometric plane which includes the planar interface 23.

Figure 12:
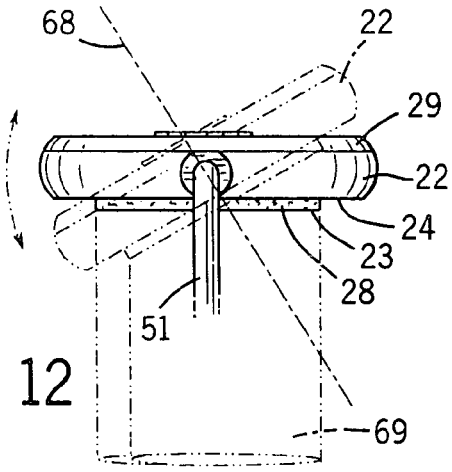
FIG. 12 is a rear elevational view of the purse holder of FIG. 1 showing a swivel engagement of the rigid interface member with the rigid arm.

As best seen in FIGS. 12, 13 and 18, a layer of padding 28 established an optimal frictional contact with a table top 21, and avoids scratching table surfaces. The padding can be formed from a variety of materials, including but not limited to felt, cork, rubber, or other materials. Those skilled in the art will recognize that in embodiments utilizing layer of padding, the planar interface 23 is technically established by the padding, not the rigid interface member 22 or the distal ends of the legs 87.

Figures 5, 6, 7, 8, 9:
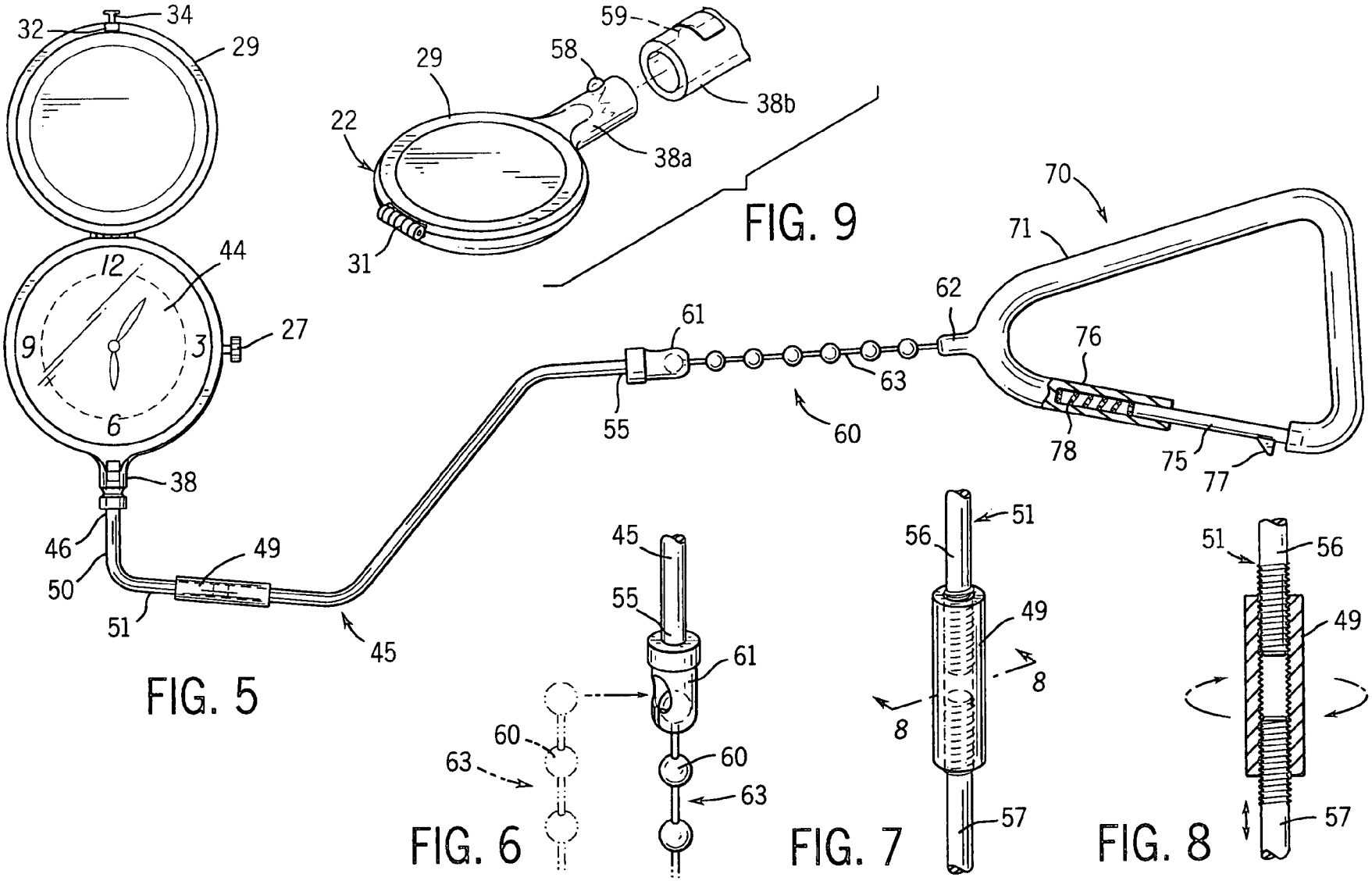
FIG. 5 is a top plan embodiment of the purse holder of FIG. 1 having a timepiece within the rigid interface member and a slide opening purse engagement member.
FIG. 6 is an isometric view of the flexible member of the purse holder of FIG. 1 comprising a swivel ball chain swivelably secured to an upper flexible member coupling.
FIG. 7 is an isometric view of a vertical extension portion of a rigid arm of the purse holder of FIG. 1 with a turnbuckle for adjusting the vertical length of the rigid arm.
FIG. 8 is a cross sectional view of the turnbuckle of FIG. 7 showing the interior thread engagement with the vertical extension.
FIG. 9 is an isometric view of an embodiment of the rigid interface member of FIG. 1 having a neck comprising a detachable ball and assembly.
Figure 10:
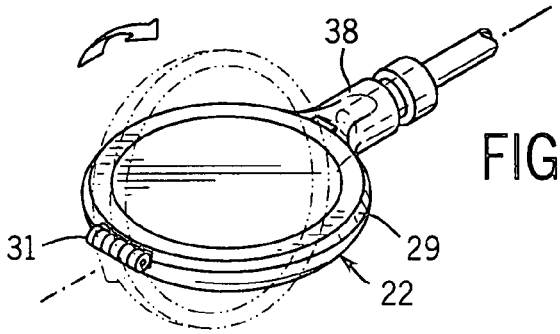
FIG. 10 is an isolated view of the rigid interface member of FIG. 1 swiveling about the rigid arm.
Figure 14:
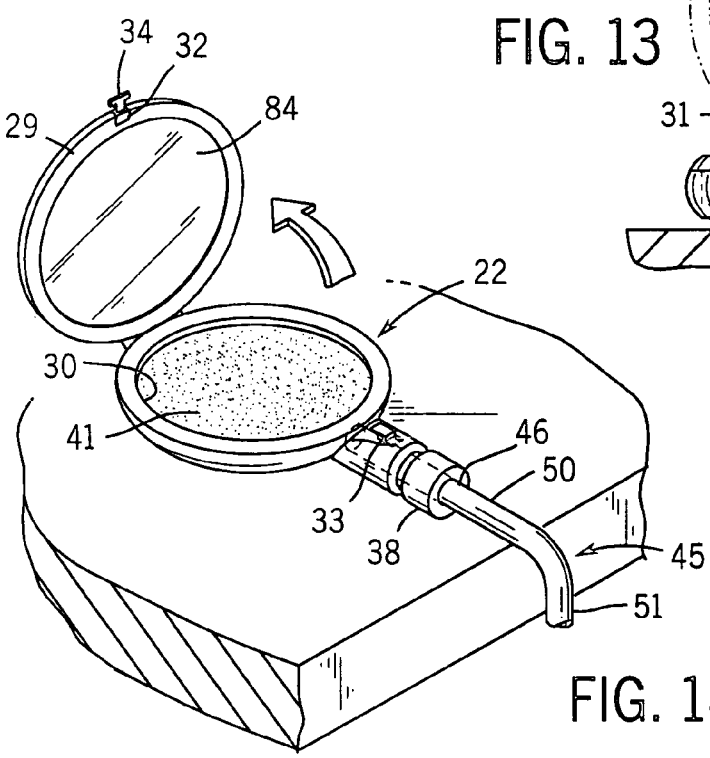
FIG. 14. is an isometric view of an embodiment of the purse holder of FIG. 13 with a mirror formed in the cover and lip gloss in the rigid interface embodiment.

According to one embodiment, the rigid interface member 22 releasably couples to a cover 29 by a securement means, shown in FIGS. 5, and 14 as a clasp and hinge assembly. An upper clasp 32 on the cover engages a lower clasp 33 on the rigid interface member to secure the cover in place. When the clasp release 34 is pressed by a user, the clasp assembly releases the cover from the rigid interface member. According to the embodiment shown in FIGS. 9, 10, and 13, an optional hinge 31 prevents the cover from detaching completely from the rigid interface member 22. A hinge can also be used independent of a clasp means. The hinge assembly 31 can advantageously be used with other mechanical closing devices, such as a two-position rocker-and-spring assembly, wherein, when the cover is below a center position, the cover is urged shut by the spring, and when lifted above the rocker point, the cover is urged open by the spring.

Figures 15, 16, 16A, 17:
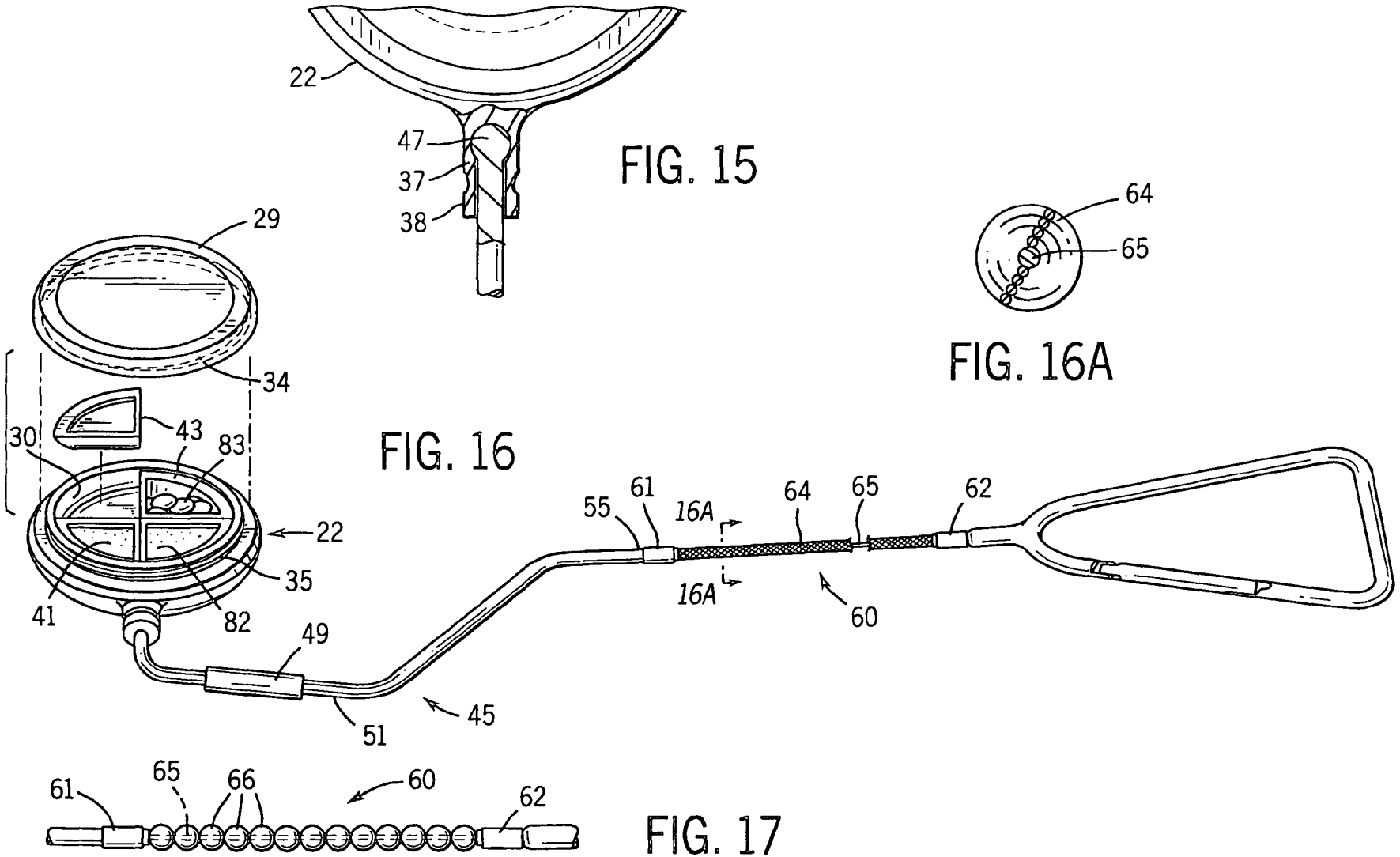
FIG. 15 is a top plan view an embodiment of the purse holder of FIG. 1 with an enlarged knob and choke flange securing the rigid interface member to the rigid arm.
FIG. 16 an isometric view of the purse holder of FIG. 1 with a threaded cover and modular insert members fitting inside the rigid interface member, and a flexible member comprising gold braid surrounding a high tensile strength core.
FIG. 16*a* is a cross sectional view of the flexible member of FIG. 16.
FIG. 17 is an embodiment of the flexible member of FIG. 1 comprised of pearls strung around a high tensile strength core.

FIG. 16 shows an alternative embodiment wherein the cover 29 releasably engages the rigid interface member in a threadable engagement. Mutually engageable upper threads 34 and lower threads 35 are respectively formed around the edges of the cover 29 and the rigid interface member 22.

As seen in FIGS. 14 and 16, a storage cavity 30 within the rigid interface member 22 can be used to store personal items, such as lip gloss 41 or other forms of make-up 82, prescription medications 83, a condom, or other small personal items. Consumable personal items such as lip gloss will preferably be stored in a pre-formed container that can be removed and replaced within the storage cavity 30. A mirror 84 on the inside surface of the hinged cover 29 allows a subject to see if unsightly food is stuck between their teeth, to accurately apply or remove make-up as necessary, to gain a jolt of confidence before hitting on someone, to scope for hot guys or girls at a table behind the user without turning around, or to simply stare vainly at themselves. FIG. 16 shows an alternative embodiment including modular inserts 43 which can be used to segregate storage of separate items, such as different shades of lip gloss or make-up, different prescription medications, etc.

FIG. 5 illustrates an embodiment comprising a timepiece 44 disposed within the storage cavity 30, and a watch stem 27 extending out of the side of the rigid interface member 22. Alternative electrical and mechanical devices such as battery operated timepieces, cameras, or cellular telephones stored within the cavity 30 are envisioned within the scope of the claimed invention. Those skilled in the art will understand that insertion ports for batteries, digital memory, cell-phone ear plugs, and other electromechanical accessories can be positioned in a variety of places, such as in the bottom surface 24, the side of the rigid interface member 22, or in the storage cavity 30 as accessed after opening the cover 29. Watches and other electronic and mechanical devices are preferably removable for battery replacement, servicing, or exchanging with other insertable devices and members.

Figure 19:
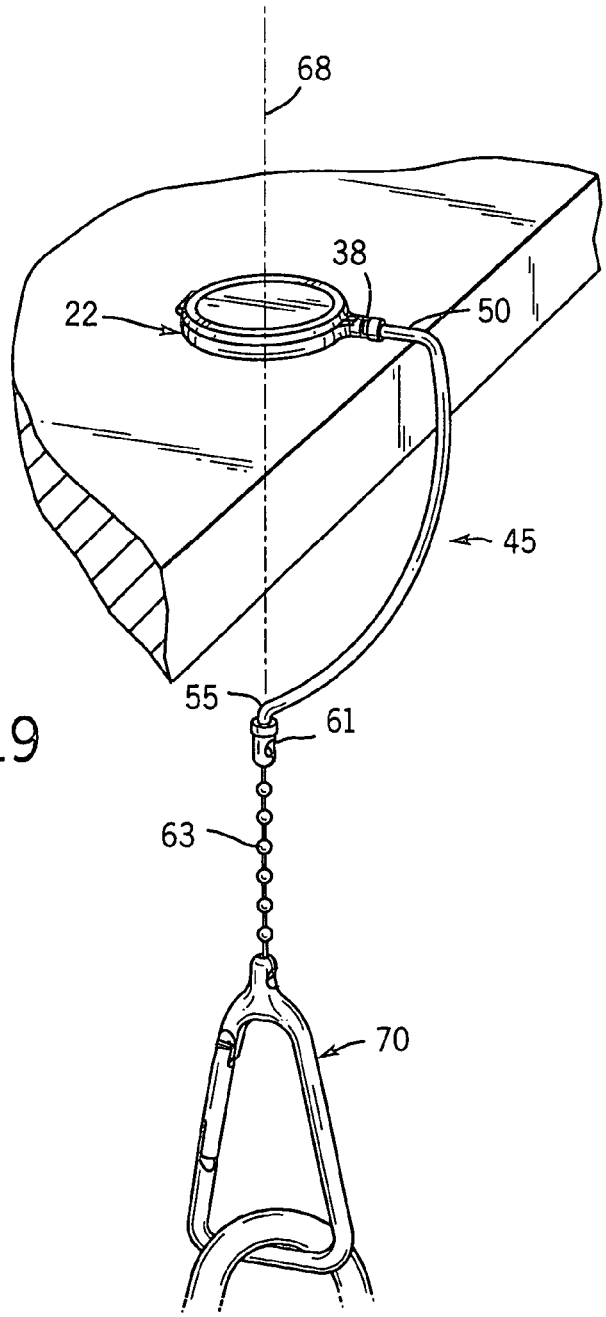
FIG. 19 is the purse hanger of FIG. 1 having a rigid arm with a progressive curve.

The upper surface of the rigid interface member, seen in FIGS. 1, 9 and 19 will preferably be a decorative member. Expensive embodiments can include onyx, lapis lazuli, or other precious or semi-precious stones, as well as porcelain, ceramic, gold, platinum and silver etchings, and other jeweled and decorative surfaces. The decorative surfaces can include various artistic displays, emblems of college and professional sports teams, casinos, restaurants, inaugurations, sports championships and other commemorative events.

A neck 38 extending horizontally from the rigid interface member 22 is discussed in greater detail in conjunction with the rigid arm 45. The neck can be integrally formed with the rigid interface member, or securely attached thereto. The axis of the neck is preferably parallel to the planar interface area 23.

The Rigid Arm

The neck 38 couples a rigid arm 45 to the rigid interface member 22.

Referring primarily to FIGS. 2, 5-12 and 14-16, the rigid arm 45 is formed from a rigid material or combination of materials that are strong enough to maintain a preformed shape while supporting the weight of a purse. Materials can include, but not limited to metal, graphite, composite and kevlar compositions or combinations. The rigid arm preferably includes a horizontal extension 50 and a vertical extension 51. Embodiments are envisioned wherein the rigid arm is single piece construction, such as a contiguous wire rod. Alternative embodiments discussed in greater detail below envision a rigid arm having multiple separate members joined by a linking piece, such as a turnbuckle.

The proximal end 46 of the rigid arm is located at the tip of the horizontal extension 50, and couples with the neck 38 of the rigid interface member 22. When the rigid arm is coupled with the neck 38, the horizontal extension of the rigid arm is parallel to the planar interface area 23.

The distal end 55 of the rigid arm couples with the flexible member 60 through an upper flexible member coupling 61.

As discussed above, the engagement between the proximal end 46 of the rigid arm 45 and the neck 38 is preferably a swivelable engagement. FIG. 5 shows a basic swivel engagement that permanently couples the horizontal extension 50 to the neck 38.

FIG. 9 shows a swivel engagement including an inner neck portion 38*a* extending from the rigid interface member 22 and an outer neck portion 38*b* coupled with the horizontal extension 50. A release means shown as a ball-detent engagement allows the rigid interface member 22 to be detached from the rigid arm 45. A depressible ball 58 in the inner neck engages a detent opening 59 in the outer neck portion 38*b* to form a ball-detent engagement. The rigid interface member 22 can be released from the rigid arm 45 by depressing the ball 58 and withdrawing the inner neck 38*a* from the outer neck 38*b*.

Figure 11:
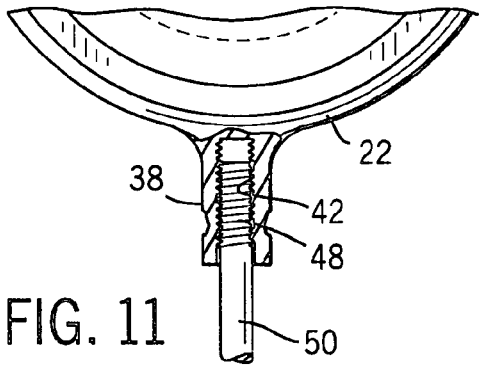
FIG. 11 is a cross sectional top plan view of a threaded neck embodiment of the purse holder of FIG. 1 engaged with a threaded rigid arm.

FIG. 11 shows an alternative swivel embodiment with a release means comprising a threaded engagement between the horizontal extension 50 of the rigid arm 45 and the neck 38. The horizontal extension 50 includes a threaded portion 48 engaged with a threaded interior 42 of the neck 38. The threaded embodiment allows the horizontal extension 50 of the rigid arm 45 to swivel within the neck 38. Although threaded engagements can allow a rigid interface member 22 to be detached from the rigid arm 45, alternative embodiments are envisioned wherein a stop, such as a thread interruption, prevents the complete unscrewing and detachment of the rigid arm from the rigid interface member.

FIG. 15 is an alternative swivelable embodiment having an enlargement shown as a rounded boss 47 formed on the proximal end of the rigid arm, and secured within the neck by a constriction shown as a choke flange 37 within the neck 38.

The specific embodiments of swivelable and releasable engagements of the rigid arm 45 and the rigid interface member 22, as described above, however, are exemplary, and are not intended to limit other swivel engagements that are fully intended within the scope of the claims, including detachable and non-detachable swivel engagements. Additionally, non-swivelable embodiments are envisioned wherein the rigid arm 45 is engaged to the neck 38 in a non-swiveling relationship.

As shown in FIGS. 1, 2, 5, 12, 14 and 16, rigid arm embodiments 45 can include a vertical extension 51 perpendicular to the horizontal extension 50. A lengthening means on the vertical extension 51, shown as a turnbuckle 49, allows adjustment of the vertical distance between the planar interface area 23 and the distal end 55 of the rigid arm 45. A vertical lengthening means allows the purse hanger 20 to be adjusted according to the thickness of the table, bar, or other horizontal surface from which a purse may be hung. By positioning the lengthening means on a vertical extension 51, the act of lengthening or shortening the vertical extension will not move the distal end 55 out of the center axis.

FIGS. 7 and 8 show an enlarged view of a lengthening means in the form of a threaded turnbuckle 49 coupling an upper member 56 and a lower member 57 of the vertical extension. According to one embodiment, the turnbuckle can be completely unscrewed from at least one of the upper and lower members 56, 57, thereby allowing the user to combine a different flexible member 60 with the purse hanger assembly. An alternative embodiment, however, envisions stops such as enlarged unthreaded portions on the upper and lower members 56, 57 that prevent detachment of the upper and lower members from the turnbuckle.

FIG. 19 illustrates alternative embodiment with a rigid arm 45 defined by a large progressive curve. The shape of the rigid arms in the figures are exemplary, and other alternative shapes are envisioned. The rigid arm can be formed from multiple members, such as two rods and a turnbuckle as shown in FIG. 16, or from single piece construction as shown in FIG. 19.

The Stable Region

As best seen in FIGS. 12, 13 and 18, the stable region 69 is the region vertically beneath the planar interface area 23. When a purse 80 is suspended by a purse hanger 20 supported by a flat surface 21, and the distal end 55 of the rigid arm 45 is within the stable region, the sum of the moments acting on the rigid interface member will be zero, allowing a purse hanger to remain in a stable orientation. In swivel embodiments, the rigid arm will be urged by gravity to pivot until the distal end 55 passes into the stable region. In non-swiveling embodiments, the distal end will be fixedly disposed within the stable region.

As noted above, the planar interface area 23 depends on the shape and arrangement of the member or members in physical contact with the tabletop. In the embodiment of FIG. 2, the planar interface area is about co-extensive with the bottom surface of the rigid interface member. In the embodiment of FIG. 13, the planar interface area 23 is defined by the bottom surface of a felt, rubber or cork pad 28 in contact with the tabletop 21. In the multi-leg embodiment 25 of FIG. 18, the planar interface area 23 is a substantially triangular area with the corners of the triangle established by the position of the three legs 87.

As best seen in FIG. 12, the stable region 69 vertically beneath the planar interface area 23 is largest when the planar interface area is horizontal. When the rigid interface member is swiveled to a non-horizontal orientation, the stable region 69 collapses in size.

The weight of a purse will naturally cause some flexure of a rigid arm, and can alter the horizontal position of the distal end 55. If bending or flexure were to move the distal end out of the stable region 69 during use, the purse hanger would become unstable. FIGS. 1, 2 and 19 show a purse hanger 20 designed, when a purse of a predetermined weight is supported by the purse hanger, the distal end 55 is aligned along the center axis 68 that intersects the geometric center 67 of the planar interface area 23 at right angles. According to this design, minor flexure of the rigid arm or minor manufacturing variations will not move the distal end 55 outside of the stable region 69 or otherwise degrade the stability or usefulness of the purse hanger. In swiveling embodiments, the arc defined by the distal end 55 will pass through the center axis 68. In non-swiveling embodiments, the distal end 55 of the rigid arm should be fixedly disposed in vertical alignment beneath the planar interface area 23 when the planar interface area is horizontal.

The Flexible Member

As best shown in FIGS. 1-5 and 16, a flexible member 60 has a first end with an upper flexible member coupling 61 for coupling with the distal end 55 of rigid arm 45, and a second end with a lower flexible member coupling 62 for coupling with the purse engagement loop 70. The flexible member can be formed from any material or combination of materials that is sufficiently flexible to allow the purse hanger 20 to be stored in a purse 80 without detaching the purse engagement loop 70 from the purse strap, and strong enough to reliably hold a purse in a suspended position. The opening in the purse can be substantially closed with the flexible member protruding through a small opening. Because part of the flexible member will remain outside the purse, the user can easily pull the remainder of the purse hanger out of the purse for use. According to a preferred embodiment, the flexible member will be between one inch and four inches in length. The appended claims, however, comprehend embodiments having a flexible member less than one inch or greater than four inches.

When a purse 80 hangs from a purse hanger as in FIG. 1, an impact against the purse 80, such as might be imparted from a knee or chair, can impart a torque to the purse which can be transmitted to the interface member 22, dislodging it from the tabletop 21. Such torque, however, can be dissipated by allowing the purse to spin when impacted by a knee or chair. The flexible member 60, therefore, should include at least one swivel member. FIG. 5 shows a purse hanger with a swivel engagement in the upper flex coupling 61, and a flexible member 60 in the form of a swivel ball chain. FIG. 2 shows a purse hanger with swivel engagements for the upper flex coupling 61 and the lower flexible coupling 62, as well as a swivel ball chain for the flexible member. FIG. 6 is an enlarged view of a swivel ball chain that can detachably connect to the upper flexible member coupling 61.

FIG. 16 and cross sectional view 16A show a non swiveling flexible member 60 comprising a flexible high strength tensile core 65 surrounded by decorative external layering, shown as gold braid 64. High strength tensile members can include, but are not limited to steel or other wire rope, nylon, spun glass, carbon kevlar, as well as composites that are not yet developed. External decorative layering can include, but is not limited to, gold, silver or platinum chain or braid, as well as other jewelry. FIG. 17 shows pearls 66 strung on a high tensile strength core 65. Because a high tensile strength core such as steel rope will impart torque when twisted, and will not release the torque through swiveling, embodiments comprising a non-swiveling flexible member such as FIGS. 16 and 17 comprise non-swivelable flexible members 60 connected with swivelable upper flexible member coupling 61 and lower flexible member coupling 62.

The Purse Engagement Loop

FIGS. 1-4 show a purse engagement loop 70 for holding the handle, or handles 81 of a purse 80. Referring to FIGS. 2 and 5, a purse engagement loop 70 is a rigid member having a primary loop member 71 and a movable loop member in the form of a hinged member 72 that is hingably secured to the primary loop member. The hinged member 72 can move between first and second positions relative to the primary loop member. A spring member urges the movable loop to the first position. When the movable loop member is moved from the first position to the second position relative to the primary loop member, the loop 70 is an open loop, and one or both purse straps 81, can be inserted through the opening and placed into the loop. When the hinged member 72 is restored to the first position, the loop 70 becomes a closed loop, securely holding the purse strap(s) inside the loop.

According to the embodiment of FIG. 2, the movable loop member 72 is attached to the primary loop member 71 by a hinge 74, and moves between the first and second positions in a swivel motion. A spring 73 exerts a force between the primary loop member and the hinged member 72 to urge the hinged member to swivel to the closed position.

The embodiment of FIG. 5 shows a primary loop member having a tubular construction 76, and a movable loop member in the form of a slidable member 75 that can slidably retract into the tubular construction. A helical spring 78 is positioned within the tubular construction to urge the slidable member 75 into a closed position. A finger tab 77 on the slidable member provides a means for a user to retract the slidable member.

An alternative embodiment for purse engagement loop 70, seen in FIG. 1, comprises a continuous loop without any movable member. During fabrication of a purse, a purse handle 81, or multiple handles, as in FIG. 1 are inserted through the continuous rigid loop 70. The purse handle is then fixed to the purse 80 in a manner known in purse construction.

The purse hanger 20 is thereby permanently or semi-permanently affixed to the purse handle.

The present invention is directed to a purse hanger for hanging a purse from a table or other horizontal surfaces. The purse hanger has a flexible member allowing the rigid interface member of the purse hanger to be stored in the purse without detaching the purse engagement member 70 from a purse strap. Many features that would be readily understood to one skilled in the art have not been discussed so as to not needlessly obscure important features of the claimed invention. At the same time, many specific details included herein are descriptive of particular embodiments, but are not essential to every embodiment comprehended by the appended claims. Accordingly, these details should not be construed to limit the scope of the claims appended hereto. It will be apparent to those skilled in the art that many modifications, alternatives and equivalent embodiments are possible without departing from the spirit and scope of the invention set forth in the appended claims.

I claim:

1. A purse hanger comprising:

a) a rigid interface member defining a planar interface area;

b) a rigid arm with a proximal segment terminating at a proximal end, a distal segment terminating at a distal end, and a central extension disposed between a proximal segment and a distal segment, wherein the proximal end is coupled with the rigid interface member, the proximal segment being in a orientation substantially parallel to the planar interface area and curving into the central extension, and wherein the central extension curves into the distal segment which extends vertically downward from the central extension when the distal end is positioned vertically beneath the planar interface area; and, c) a flexible member with a first end coupled to the distal end of the rigid arm, and a second end coupled to a purse engagement member.

2. The purse hanger according to claim 1 wherein the distal end of said rigid arm is oriented vertically beneath the geometric center of said planar interface area.

3. The purse hanger according to claim 1 wherein the rigid arm is swivelably coupled with the rigid interface member.

4. The purse hanger according to claim 1 wherein the rigid arm is detachably coupled with the rigid interface member.

5. The purse hanger according to claim 1 wherein the rigid interface member has a storage cavity.

6. The purse hanger according to claim 5 further comprising storage members stored in said storage cavity, said storage members being selected from among a group consisting of lip gloss, foundation, make up, vitamins, drugs, a condom, modular inserts, a timepiece, a cellular telephone, a camera and combinations thereof.

7. The purse hanger according to claim 5 further comprising a cover for covering said storage cavity, and securement means for securing said cover to said rigid interface member.

8. The purse hanger according to claim 7 wherein said securement means is selected from among a group consisting of snaps, clasps, hooks, hinges, magnets, threaded members, and combinations thereof.

9. The purse hanger according to claim 1 wherein said rigid arm comprises a horizontal extension parallel with said planar interface area.

10. The purse hanger according to claim 9 wherein the rigid arm comprises a vertical extension that is about perpendicular to said horizontal extension.

11. The purse hanger according to claim 10 wherein the vertical extension has a lengthening means for altering a length of the vertical extension.

12. The purse hanger according to claim 1 wherein the first end of the flexible member is coupled to the distal end of the rigid arm by a swivel joint.

13. The purse hanger according to claim 1 wherein the second end of the flexible member is coupled to the purse engagement member by a swivel joint.

14. The purse hanger according to claim 1 wherein the purse engagement member is a rigid loop.

15. The purse hanger according to claim 14 wherein the rigid loop is a single continuous loop.

16. The purse hanger according to claim 14 wherein the rigid loop is a formed from a movable loop member movably engaged to a primary loop member, wherein, when the movable loop member is in a first position, the rigid loop is a closed loop, and when the movable loop member is in a second position, the rigid loop is an open loop.

17. The purse hanger according to claim 16 wherein the movable loop member is movably engaged to the primary loop member through a pivot member.

18. The purse hanger according to claim 16 wherein the movable loop member is slidably engaged to the primary loop member through a slide means.

19. The purse hanger according to claim 18 wherein said slide means includes a tubular member into which the movable loop member can retract.

20. The purse hanger according to claim 16 further comprising a spring member for urging said movable loop member toward said first position.

21. In combination:

a) a horizontal surface; and b) a purse hanger for hanging a purse from a horizontal surface, the purse hanger comprising:

(i) a rigid interface member with a planar interface configured to rest on said horizontal surface;

(ii) a rigid arm with a proximal segment terminating at a proximal end, a distal segment terminating at a distal end, and a central extension extending from a the proximal segment through a first bend, and extending into the distal segment through a second bend, the central extension being oriented, at least in part, in a direction different from the proximal segment, and in a direction different from the distal segment, the proximal end being coupled to said rigid interface member, wherein the rigid arm is configured to position the distal segment in a vertical orientation that is vertically aligned beneath the rigid interface member when the rigid interface member is disposed on the horizontal surface;

c) a flexible member with first and second ends, said first end of said flexible member secured to said distal end of said rigid arm; and d) a purse engagement member coupled with said second end of said flexible member.

22. The purse hanger of claim 21 wherein the flexible member is at least one inch long.

23. The purse hanger of claim 21 wherein said purse engagement member is a rigid loop.

24. The purse hanger of claim 23 wherein the rigid loop comprises a primary loop member coupled to a movable loop member, said movable loop member being movable between first and second positions, wherein, in said first position, said rigid loop is a closed loop, and in said second position, said rigid loop is an open loop.

25. The purse hanger of claim 24 further comprising a spring member engaged with said primary loop member and with said movable loop member to urge said movable loop member to said first position.

26. The purse hanger according to claim 21 wherein said rigid arm has a lengthening member.

27. The purse hanger according to claim 26 wherein said lengthening member comprises a turnbuckle.

28. The purse hanger according to claim 21 further comprising a storage cavity within said rigid interface member.

29. The purse hanger according to claim 28 further comprising a cover for covering said storage cavity, and a cover engagement means for engaging said cover to said rigid interface member.

30. The purse hanger of claim 29 wherein the cover engagement means is selected from among a group consisting of hinges, clasps, threaded members, chains, clips, and combinations thereof.

31. The purse hanger according to claim 28 further comprising storage members stored within said storage cavity, said storage members selected form among a group consisting of lip gloss, foundation, modular dividers, vitamins, prescription medication, a condom, a cell phone, a time piece, a camera, and combinations thereof.

32. The purse hanger according to claim 7 further comprising a mirror on a surface of said cover.

33. The purse hanger according to claim 29 further comprising a mirror on a surface of said cover.

34. A purse hanger comprising:

a) a rigid interface member with a planar interface area;

b) a bent rigid arm with a proximal segment terminating at a proximal end, and a distal segment terminating at a distal end, wherein the proximal segment is coupled to said interface member in an orientation substantially parallel to the planar interface area, the rigid arm being configured such that the distal segment is aligned in a vertical orientation vertically beneath the planar interface area when the planar interface area is horizontal, and wherein the distal end comprises a securement member;

c) a flexible member with first and second ends, said first end of said flexible member secured to the securement member; and d) a purse engagement member coupled with said second end of said flexible member.

35. The purse hanger or claim 34 wherein the rigid arm comprises a central segment disposed between the proximal segment and the distal segment, the central segment comprising a vertical extension.

36. The purse hanger of claim 34 wherein at least one bend within the rigid arm comprises a large progressive curve.

37. The purse hanger of claim 35 wherein the proximal segment of the rigid arm is swivelably coupled to the rigid interface member while rigidly fixed along a horizontal line relative to a surface of the rigid interface member.

* * * * *